United States Patent [19]

Kobayashi et al.

[11] Patent Number: 5,075,728

[45] Date of Patent: Dec. 24, 1991

[54] DEVELOPING APPARATUS WITH DEVELOPER LEAK PREVENTION

[75] Inventors: Yoshiaki Kobayashi, Tokyo; Hatsuo Tajima, Matsudo, both of Japan

[73] Assignee: Canon Kabushiki Kaisha, Tokyo, Japan

[21] Appl. No.: 572,404

[22] Filed: Aug. 27, 1990

[30] Foreign Application Priority Data

Sep. 29, 1989 [JP] Japan ..... 1-220458

[51] Int. Cl.[5] ..... G03G 15/06

[52] U.S. Cl. ..... 355/260; 118/656; 355/245

[58] Field of Search ..... 355/245, 260, 259, 215, 355/251, 253; 118/656, 651, 653; 206/316.1, 316.2, 316.3

[56] References Cited

U.S. PATENT DOCUMENTS

| | | | |
|---|---|---|---|
| 4,528,936 | 7/1985 | Shimazaki et al. | 118/653 |
| 4,596,455 | 6/1986 | Kohyama et al. | 355/260 |
| 4,616,918 | 10/1986 | Kohyama et al. | 355/259 |
| 4,632,535 | 12/1986 | Nagata | 355/259 |
| 4,656,965 | 4/1989 | Hosoya et al. | 118/651 X |
| 4,809,036 | 2/1989 | Yamashita et al. | 355/259 |
| 4,870,463 | 9/1989 | Miyoshi et al. | 118/653 |

*Primary Examiner*—A. T. Grimley
*Assistant Examiner*—Sandra L. Brase
*Attorney, Agent, or Firm*—Fitzpatrick, Cella, Harper & Scinto

[57] ABSTRACT

A developing apparatus includes a container having a first chamber and a second chamber, the second chamber containing a developer; a rotatable developer carrying member in the first chamber to carry the developer through a developing zone where an electrostatic latent image on an image bearing member is developed; a rotatable supply member disposed in the first chamber and cooperative with the developer carrying member to form a nip therebetween to supply the developer supplied from the second chamber to the developer carrying member; and a partition wall between the first chamber and a second chamber having an opening for permitting supply of the developer from the second chamber to the supply member, wherein the opening has a length smaller than a length of the supply member.

71 Claims, 6 Drawing Sheets

DEVELOPING APPARATUS WITH DEVELOPER LEAK PREVENTION

FIELD OF THE INVENTION AND RELATED ART

The present invention relates to a dry developing apparatus usable with a copying machine, an image display machine, an image recording machine, a printer, a facsimile machine or the like and capable of developing into a visualized image a latent image formed on a latent image bearing member such as an electrophotographic photosensitive member, an electrostatic recording dielectric member or the like.

It is known that a thin layer of a developer to be supplied to a developing zone is formed by an elastic blade made of rubber, metal or the like material contacted to a developing roller, as disclosed in U.S. Pat. No. 4,458,628, for example. The developer is regulated into a thin layer when it is passed through a nip formed between the developing roller and the elastic member. Simultaneously, the developer is triboelectrically charged.

U.S. Pat. No. 4,616,918 discloses a developing roller having a surface roughened except for the marginal areas at the longitudinally opposite ends of the nip. By doing so, the developer is prevented from being scattered to the outside of the roughened surface, and therefore, the developer is prevented from leaking out through the longitudinal ends of the developing roller.

U.S Pat. No 4,528,936 discloses a gate member faced to a developing roller immediately before the elastic blade The gate member is effective to suppress the leakage of the developer through the longitudinally opposite ends of the developing roller.

European Patent Application 0,314,436A discloses that magnetic members are disposed adjacent the opposite ends of an elastic blade to prevent the developer from leaking through the opposite ends of the elastic blade.

Japanese Laid-Open Patent Applications Nos. 7068/1987 and 192770/1987 disclose that sealing members are abutted to the opposite ends of the elastic blade to prevent the leakage of the developer through the clearance between the container and the developing roller. In the former publication, the surface of the developing roller is roughened, but the surface is not roughened in the regions where the blade is contacted adjacent to the opposite ends.

U.S. Pat. No. 4,632,535 discloses a developing apparatus wherein the layer of the developer is regulated by an elastic blade, and an elastic sheet is disposed adjacent a return opening through which the developer having passed through the developing zone returns into the developer container. The elastic sheet contacts the developing roller to prevent the leakage of the developer at the return opening.

Japanese Laid-Open Patent Applications Nos. 116559/1983 and 159675/1986, U.K. Patent No. 2,163,371 and U.S. Pat. No. 4,836,135 disclose that a supply roller is rotated in contact with the developing roller, by which the developer is applied on the developing roller. This is effective particularly to supply a one component non-magnetic developer to the developing roller. This is because, although a one component magnetic developer or a two component developer containing magnetic carrier particles can be supplied to the developing sleeve using magnetic force of a magnet disposed within the developing sleeve, the one component non-magnetic developer is not controlled by the magnetic force, so that it is preferable to mechanically supply to the developer the developing roller using the supply roller.

The one component non-magnetic developer leaks more easily from the developing apparatus than the magnetic developer. In the apparatus wherein the supply roller is used to enhance the supply of the developer to the developing roller, the developer increasingly leaks or scatters from the longitudinal opposite ends of the developing roller.

Referring to FIG. 1, the passage through which the developer leaks will be described. An image bearing drum 1 such as an electrophotographic photosensitive member on which the electrostatic latent image is formed is rotated in the direction indicated by an arrow 1. The latent image is developed by a developing device 20. The one component non-magnetic developer, which will hereinafter be called simply "toner", in a developer accommodating chamber 22 of the container 2 is supplied to a supply roller 5 through an opening 24 of an intermediate wall 23 by a toner supply member 6*a*. At this time, the toner flows into the clearance between the supply roller 6 and the side wall 25 (only the rear side is shown, but the front side is shown in the subsequent drawings), and then flows through the clearance between the developing roller 3 and the container 2 to the outside of the container. The toner having reached the clearance between the supply roller 5 and the side wall goes by the rotation of the developing roller to the position where the developing roller 3 and the elastic blade 4 are contacted. Here, the developer leaks out of the container through the clearance between the elastic blade and the side wall. Where the toner particles are spherical, or the toner particle size distribution is sharp to increase the image quality, the flowability of the toner is enhanced, with the result that the leakage increases greatly. In any event, the leaked toner contaminates the inside of the apparatus and the resultant image quality deteriorates.

SUMMARY OF THE INVENTION

Accordingly, it is a principal object of the present invention to provide a developing apparatus capable of effectively preventing the leakage of the developer.

It is another object of the present invention to provide a developing apparatus in which the developer is effectively prevented from leaking out of the apparatus through ends of the supply roller.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

Figure 1:
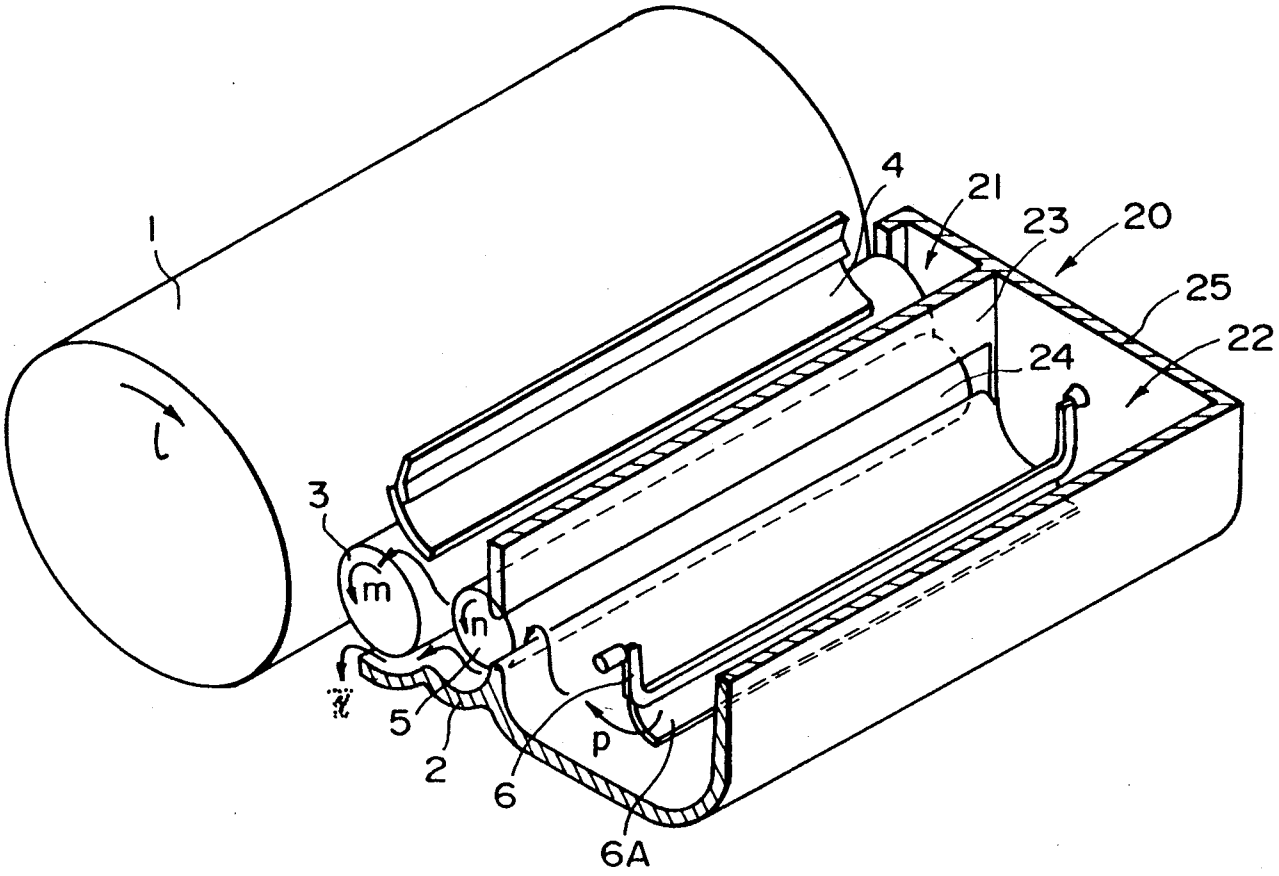
FIG. 1 is a perspective view of a developing apparatus from which the present invention starts.
Figure 2:
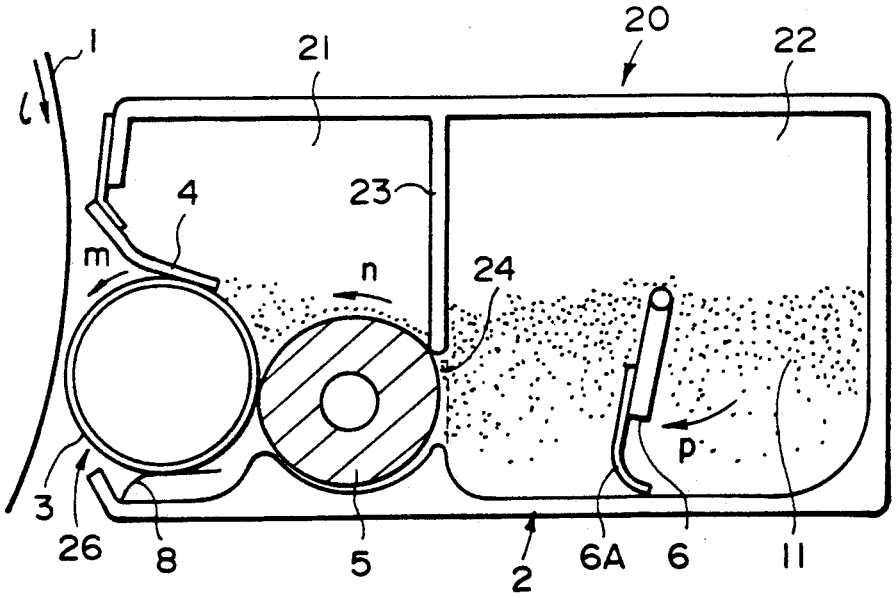
FIG. 2 is a sectional view of a developing apparatus according to a embodiment of the present invention.

Referring to FIG. 2, there is shown a developing apparatus according to an embodiment of the present invention. The developing apparatus 20 develops an electrostatic latent image formed on an image bearing member rotatable in a direction indicated by an arrow 1. The image bearing member 1 may be a photosensitive member on which an electrostatic latent image is formed by a Carlson process, for example, a photosensitive member having a surface insulating layer on which an electrostatic latent image is formed through the process disclosed in U.S. Pat. No. 3,666,363, an insulating member on which a latent image is formed through an electrostatic recording process, an insulating member on which an electrostatic latent image is transferred through an image transfer process, or a member for carrying electrostatic latent image (or potential latent image) or a magnetic latent image by proper process.

The developing apparatus 20 comprises a container 2, a developing roller 3 (developer carrying member) and an elastic blade 4 for regulating a thickness of a developer layer. The container 2 has an opening 26 extending in a direction of the length of the developing device (perpendicular to the sheet of the drawing). The opening 26 is faced to the image bearing member 1. In the opening 26, the developing roller 3 is disposed. The developing roller 3 is made of non-magnetic material such as aluminum or the like. The developing roller 3 is in the form of a sleeve, and substantially the right half periphery thereof is in a first chamber 21 of the container 2, and substantially the left half periphery is exposed to the outside of the container. The developing sleeve is supported on the container for rotation in a direction m. The developer carrying member 3 may be in the form of an endless belt or the like rotationally driven rather than a cylindrical (sleeve) member. It may be in the form of an electrically conductive rubber roller. The exposed surface of the developing roller 3 is faced to the surface of the photosensitive member 1 with a small clearance to form a developing zone for developing the latent image.

The elastic blade 4 is mounted on the container 2 at a toner outlet from the first chamber 21 and contacts the outer surface of the developing roller 3. The blade 4 is inclined downwardly with respect to the rotational direction of the sleeve, that is, counterdirectional relative to the sleeve rotation. The blade 4 may be inclined in the opposite direction, that is, codirectionally with respect to the rotation of the roller 3. The blade 4 may be made of rubber plate, leaf spring of metal, synthetic resin sheet or the like. The blade 4 functions to regulate a thickness of the toner layer formed on the developer carrying member and conveyed to the developing zone. More particularly, the toner layer is regulated into a thin layer by passing through the nip formed between the roller 3 and the blade 4 which is elastically born thereon. During the passage through the nip, the toner particles are triboelectrically charged to a polarity proper to develop the latent image by the friction between the toner particles and the roller 3 and between the toner particles and blade 4.

At an inlet portion of the first chamber 21 where the toner not consumed in the development in the developing zone returns by the rotation of the roller 3, an elastic sheet 8 made of thin rubber sheet, thin synthetic resin sheet or the like bears on the developing roller 3, so that they lightly contact to each other to prevent the toner in the container 2 from leaking out of the container.

In the first chamber 21, there is an elastic supply roller 5 extending in parallel with the, developing roller 3. The supply roller 5 contacts the developing roller 3, by which it is slightly elastically deformed to form a nip with the developing roller 3, at a position upstream of the nip between the developing roller 3 and the blade 4 and downstream of the nip between the sheet 8 and the roller 3 with respect to the rotational direction of the roller 3. In the example shown in the Figure, the supply roller 5 is driven to rotate in the direction n, but it may be rotated in the opposite direction. In any case, the supply roller 5 functions to supply the toner supplied from the second chamber 22 to the developing roller 3 and also functions to remove, from the roller 3, the toner returned into the first chamber 21 and then to supply the removed toner to the developing roller 3. The toner returning into the first chamber 21 without being consumed in the development is removed from the developing roller 3 or stirred on the developing roller 3 by the supply roller 5 to prevent development memory. When the toner is applied on the developing roller 3 by the roller 5, it is triboelectrically charged to a polarity proper to develop the latent image, by the friction between the toner and the roller 3 and/or between the toner and the roller 5.

The supply roller 5 may be made of continuously porous sponge rubber, independently porous sponge rubber, non-sponge rubber, a brush roller or the like.

Figure 3:
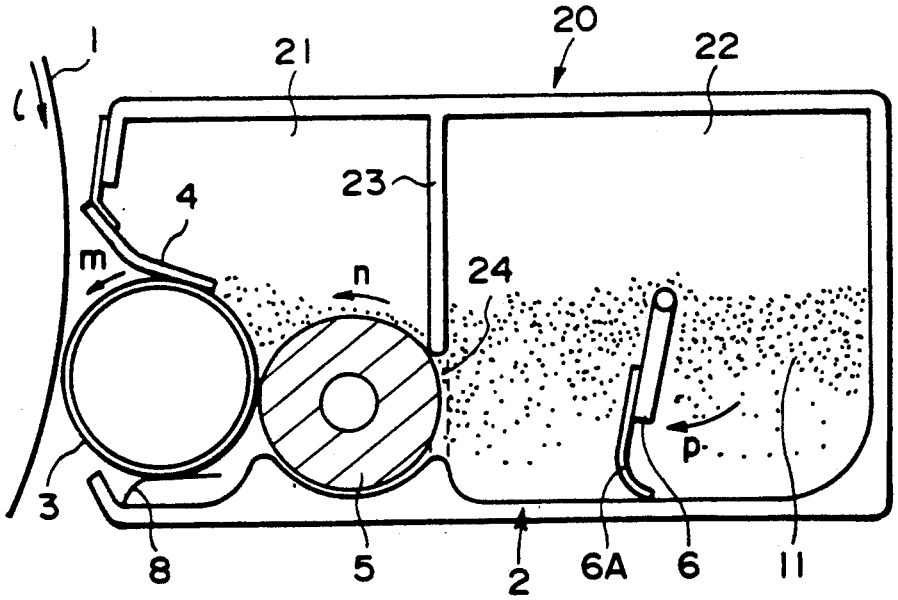
FIG. 3 is a sectional view of a developing apparatus according to another embodiment of the present invention.
Figure 4:
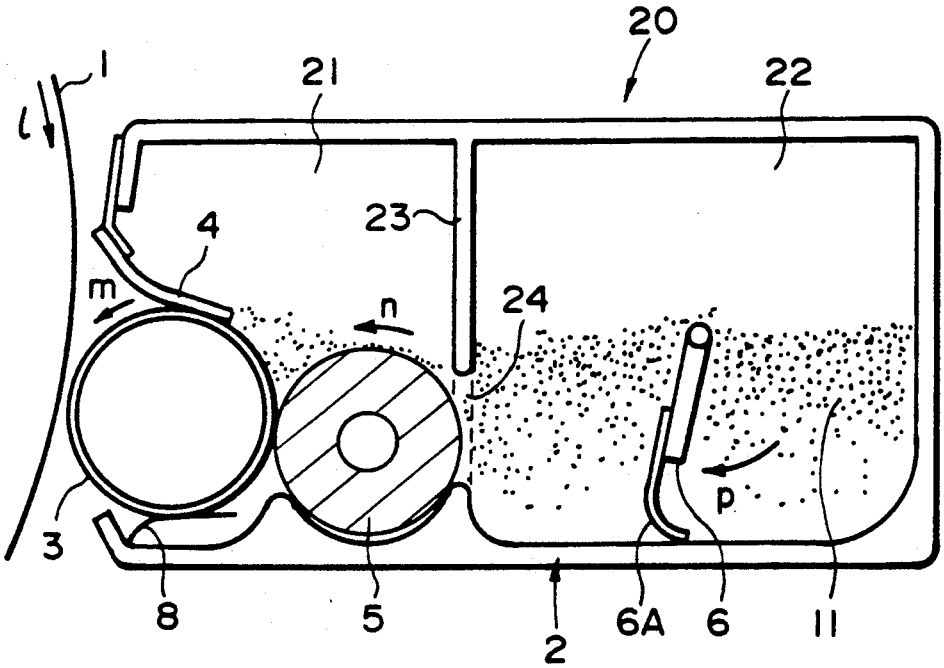
FIG. 4 is a sectional view of a developing apparatus according to a further embodiment of the present invention.

The first and second chambers 21 and 22 of the container 2 are divided by a wall 23. The wall 23 has an opening through which the toner 11 contained in the second chamber 22 passes to the elastic supply roller 5. The peripheral surface of the supply roller 5 lightly contacts the edge of the opening 24 to prevent excessive toner from going into the first chamber 21. In FIG. 2, the roller 5 is in contact with all of the edges of the opening 24 to close the opening 24 relative to the first chamber 21. However, as shown in FIG. 3, the roller 5 may be out of contact with the lower edge of the opening 24, or as shown in FIG. 4, out of contact with the upper edge of the opening 24. In FIGS. 3 or 4, the clearance between the roller 5 and the non-contacts edge of the opening 24 is preferably small to prevent the excessive toner from going into the first chamber 21 from the second chamber 22.

In the second chamber 22, a toner supply member 6 is disposed. The toner supply member 6 is rotatably supported on a shaft parallel with the rotational axis of the developing sleeve 3 and is provided with an elastic sheet 6A for feeding the toner. The toner supply member 6 rotates in a direction p to stir the toner contained in the second chamber 22 and to feed the toner to the roller 5 through the opening 24.

Figure 5:
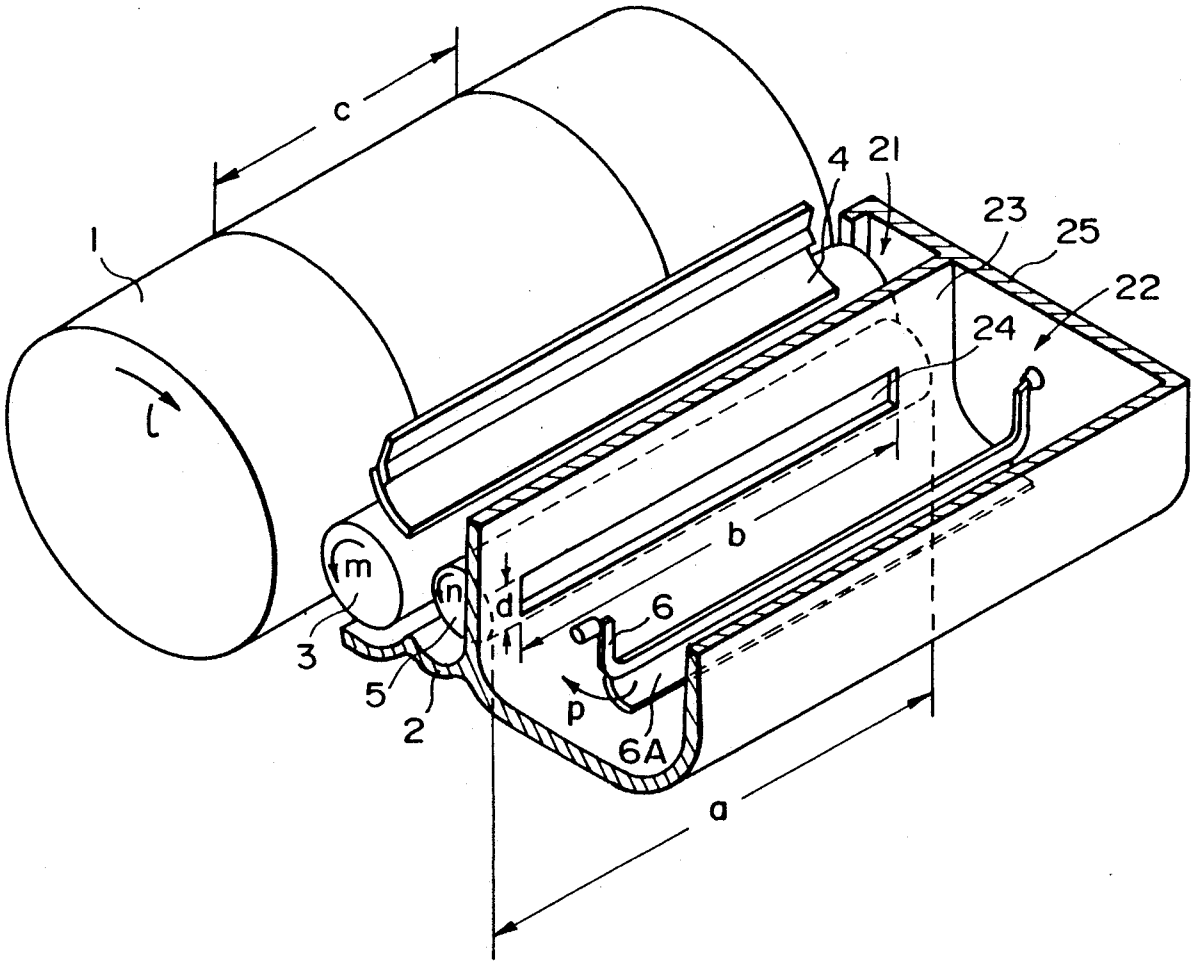
FIG. 5 is a perspective view of a developing apparatus according to an embodiment of the present invention.

As shown in FIG. 5, the length b of the opening 24 is smaller than the length a of the supply roller 5. Therefore, the opposite end portions of the supply roller 5 do not receive the toner through the opening 24 (the length -a or b in this Specification means a dimension measured in the longitudinal direction of the developing roller).

When the developing device is operated, the toner supply member 6 rotates in the direction p, by which the toner is fed to the elastic roller 5 through the toner flow limiting opening 24. In this embodiment, the length b of the opening 24 and the length a of the elastic supply roller 5 satisfy a>b, and therefore, the toner flowing area is limited to b when it is supplied to the elastic roller 5, and therefore, the toner flow into the clearance between the elastic roller 5 and the side wall 25 is significantly reduced, so that the leakage of the toner through the container end portions can be significantly reduced. If the elastic roller 5 is in contact with the edges of the opening 24, the limiting function is further enhanced, so that the leakage preventing effect through the ends of the container is further enhanced. As shown in FIGS. 3 and 4, the preventing effects can be provided if the elastic roller 5 is in contact with one of top and bottom edges of the opening 24, but it is preferable that it is in contact with the entire edge of the opening 24 as shown in FIG. 2.

Where the edge of the opening 24 is in contact with the elastic roller 5, the contact pressure therebetween is preferably small so as not to increase the torque load. Therefore, the material of the elastic roller 5 is preferably sponge having continuous pores and wrapped around a metal cap.

In order for the toner to reach the developing roller with the length (width) b being maintained, the length c of the image formation region and the length b of the toner limiting opening 24 preferably satisfy $b \geqq c$.

The description will be made as to the specific example and the effects of the developing apparatus.

(1) The developing roller 3 used was made of aluminum having a diameter of 20 mm, and the surface thereof was sand-blasted by irregular blasting particles.

(2) The elastic blade 7 was made of urethane rubber (rubber hardness of 65 degrees (JIS)) having a thickness of 2 mm.

(3) The elastic roller 5 had a stainless steel core having a diameter of 7 mm enclosed by a sponge (Everlight (trade name)). It had an outer diameter of 18 mm in the form of a roller. It was rotated in the same direction as the developing sleeve so that the relative peripheral speed therebetween was 50–300 mm/sec.

(4) The toner supply member 6 was made of stainless steel bent into a crank form. At the free long edge, a polyethylene terephthalate film having a length of 10 mm and a thickness of 50 microns was attached.

(5) The length b of the toner limiting opening 24 was such that the opening was shorter than the elastic roller 5 end by 5 mm at each of the longitudinal ends, and the width (height) d was 7 mm. The bottom edge of the opening 24 was contacted to the elastic roller 5.

(6) The toner was red toner comprising 100 parts by weight of copolymer of styrene/acryl resin and styrenebutadiene resin and 5 parts by weight of red perylene pigment. The toner particles had the average particle size of 13 microns. To the toner particles, 1.0 % of colloidal silica was added.

Such a developing device was incorporated in a copying machine (NP1215 available from Canon Kabushiki Kaisha, Japan). After 2000 sheets were processed the leakage of the toner in the copying machine was observed. It was confirmed that the inside of the machine was hardly contaminated by the leakage from the end portions of the developing device.

The developing process will be described. It may be as disclosed in U.S. Pat. No. 4,395,476 wherein a small clearance is provided between the image bearing member (photosensitive member) 1 and the developing roller 3; a DC biased alternating voltage is applied to the developing roller to transfer the thin toner layer having a thickness smaller than the clearance on the developing roller 3 onto the electrostatic latent image on the photosensitive member. The present invention is applicable to the other developing system, for example, the system wherein the toner layer is contacted to the photosensitive member.

The same experiments were performed using a developing device in which the length b of the opening 24 is the same as the length a of the elastic roller 5. It was confirmed that the toner was leaked through the opposite ends of the developing device, so that an image transfer charger within the copying machine was contaminated with the result of improper copying operation.

In order to further enhance prevention of toner leakage it is preferable that the following structure is employed in addition to the structure described in the first embodiment.

Figure 6:
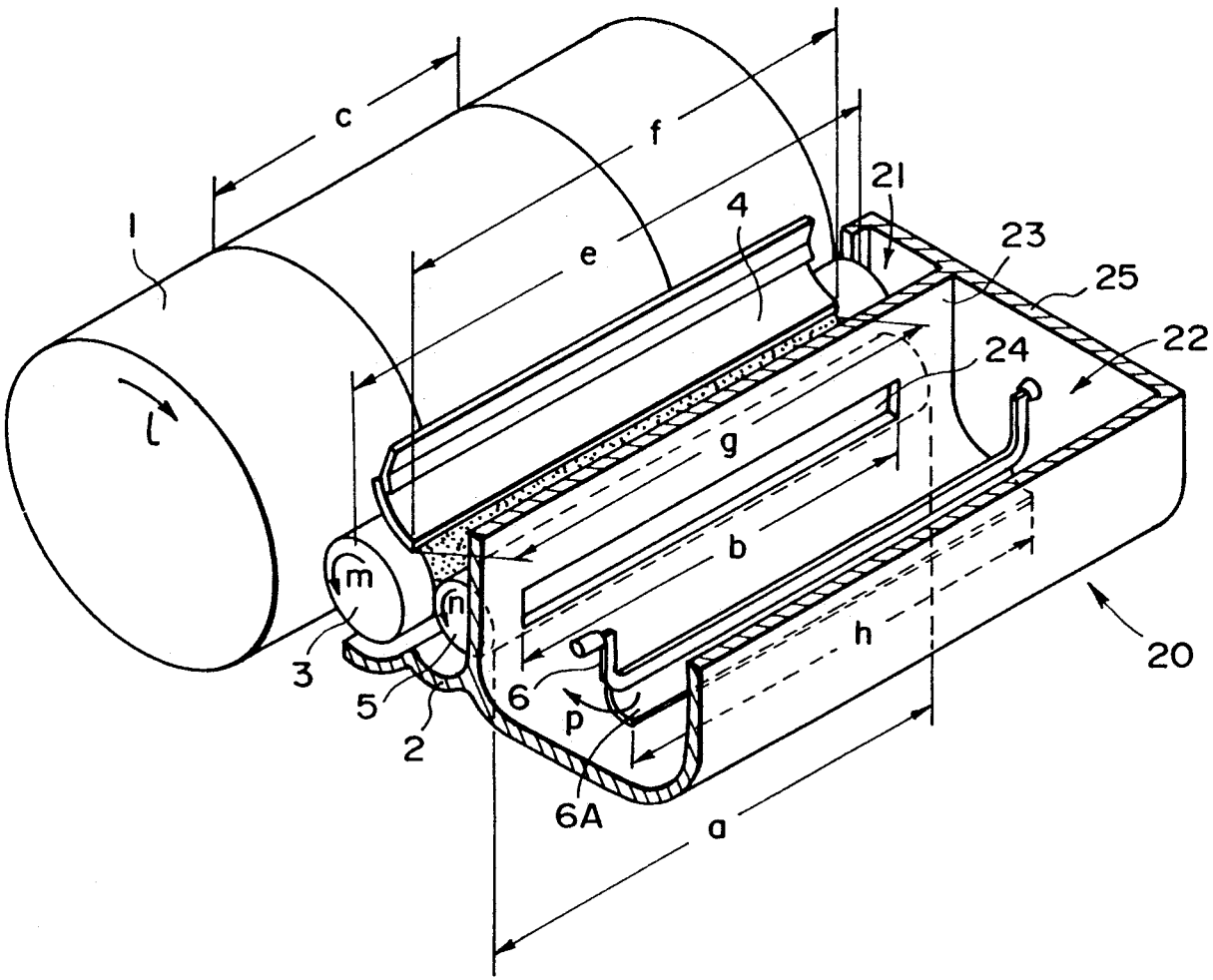
FIG. 6 is a perspective view of a developing apparatus according to a further embodiment of the present invention.

As shown in FIG. 6, the length e of the developing roller 3, the length f of the nip between the elastic blade 4 and the developing roller 3, the length g of the roughened surface area 9 of the developing roller 3, the length -a of the elastic roller, the length b of the toner flow limiting opening 24 and the length c of the image formation area on the image bearing member, satisfy $$e \geqq f > g > a > b \geqq c.$$

Then, toner leakage prevention at the ends of the container is further enhanced (the lengths c, e, f and g are the dimension measured in the direction parallel to the axis of the developing roller 3).

When the rotational speed of the elastic roller 5 is high or when the amount of toner supply is large, the toner reaching the elastic roller 5 through the opening 24 may expand beyond the length a of the elastic roller 5*a* adjacent the developing roller 3 due to the rotation of the elastic roller 5. At this time, if the length e of the developing roller 3 is larger than the length a of the elastic roller 5 (e>a), the developing roller 3 functions as a barrier to prevent the expanded toner from leaking out of the container. If the length f of the nip between the elastic blade 4 and the developing roller 3 is larger than the length a of the elastic roller (f>a), the supply region of the toner on the developing roller 3 is larger than the length a of the elastic roller, so that even if the toner reaches the nip between the elastic blade and the developing roller, the toner is triboelectrically charged by the nip without leakage, and therefore, the electrostatic attraction to the developing roller is increased. Therefore, the leakage can be prevented. If the length g of the roughened surface area of the developing roller 3 is larger than the length a of the elastic roller 5 (g>a) and if it is smaller than the length f of the nip between the elastic blade and the developing roller (f>g), the toner is smoothly conveyed by the rotation of the developing roller 3 even if the width of the toner flow is larger than the length a of the elastic roller 5 adjacent the developing roller 3, because the roughened surface area having strong toner conveying power continues from immediately outside of the nip between the elastic roller 5 and the developing roller. By the smooth conveyance, the toner reaches the nip between the elastic blade 5 and the developing roller 3, so that the leakage through the bottom of the container can be reduced. Additionally, even if the toner flow expands to the smooth surface outside the roughened surface region at the nip between the elastic blade and the developing roller, the elastic blade rubs the toner with the smooth surface, so that the triboelectric charge of the toner is enhanced with thin layer thickness, and therefore, the toner is strongly attracted to the developing roller by the electrostatic force, thus suppressing the leakage.

The surface of the developing roller may be blasted with irregular particles having edges or regular particles having spherical shape, or by abrading with sand paper. The roughened surface can provide stronger toner conveying power, and is effective to prevent excessive triboelectric charge of the toner.

As shown in FIG. 6, it is further preferable that a length h of the toner supply member 6A in the second chamber 22 measured along a direction parallel with the axis of the roller 3, and the length b of the opening 24 satisfy $h \geqq b$, since then the toner can be supplied to the elastic roller 5 over the entire longitudinal region of the opening 24. The length h may be smaller than the length a.

Figure 7:
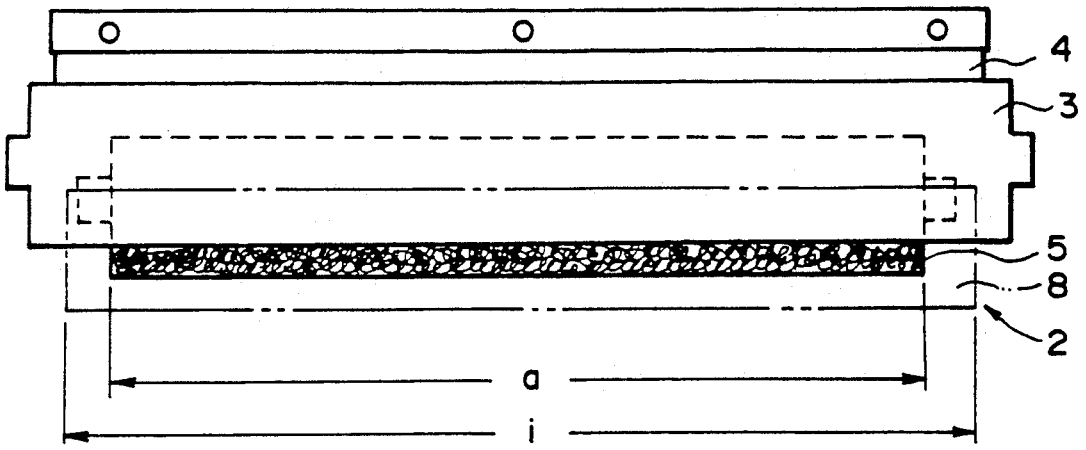
FIG. 7 illustrates dimensional relations in a developing apparatus according to a further embodiment of the present invention.

As shown in FIG. 7, in addition to the structure of the above embodiments, it is further preferable that a length i of the elastic sheet 8 contacting the bottom portion of the developing sleeve measured in a direction parallel with the axis of the roller 3 is larger than the length a of the elastic roller 3 ($i > a$). By doing so, even if the toner flows to the outside of the opposite ends of the elastic roller 5, the toner is blocked by the sheet 8, and therefore, it does not directly fall.

Figure 8:
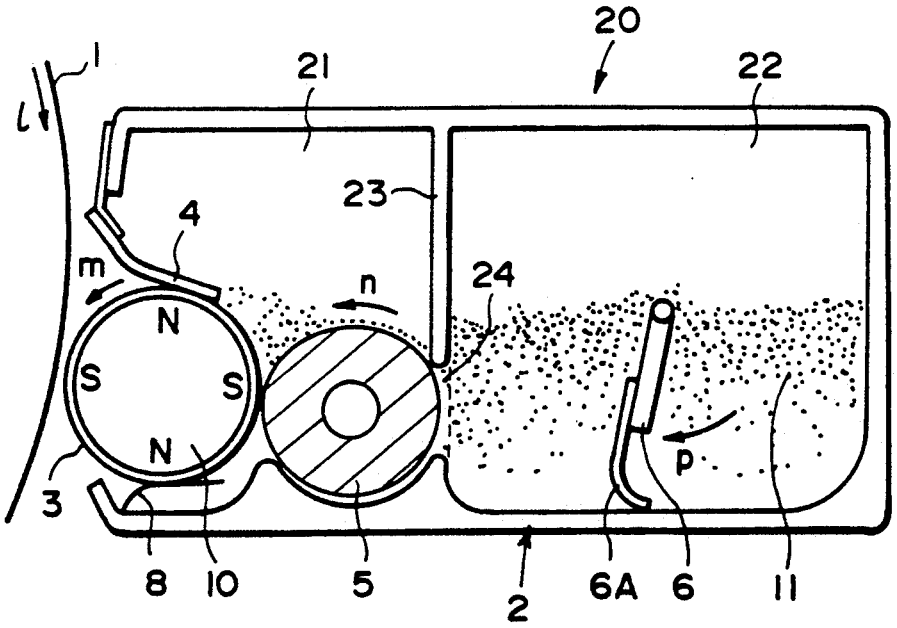
FIG. 8 is a sectional view of a developing apparatus according to a further embodiment of the present invention.

The developer may be a one component magnetic developer. In this case, as shown in FIG. 8, a magnet roller 10 may be stationarily disposed in the developing sleeve 3, and its magnetic force used to convey the magnetic toner. At the developing zone, the magnetic force is used for the developing action. The developer may be further prevented from leaking through the ends of the sleeve in the above-described manner and additionally by use of the magnetic force.

While the invention has been described with reference to the structures disclosed herein, it is not confined to the details set forth and this application is intended to cover such modifications or changes as may come within the purposes of the improvements or the scope of the following claims.

What is claimed is:

1. A developing apparatus, comprising:

a container having a first chamber and a second chamber, said second chamber containing a developer;

a rotatable developer carrying member in said first chamber to carry the developer through a developing zone where an electrostatic latent image is developed on an image bearing member;

a rotatable supply member disposed in said first chamber and cooperative with said developer carrying member to form a nip therebetween to supply the developer supplied from said second chamber to said developer carrying member; and a partition wall between said first chamber and said second chamber having an opening for permitting a partition wall between said first chamber and said second chamber having an opening for permitting supply of the developer from said second chamber to said supply member, wherein the opening has a length smaller than a length of said supply member and larger than an image formation are of the image bearing member.

2. An apparatus according to claim 1, wherein said supply member is contacted to an edge of the opening.

3. An apparatus according to claim 2, wherein said supply member has an elastic roller.

4. An apparatus according to claim 3, wherein said supply member has a sponge rubber roller.

5. An apparatus according to any one of claims 1–4, wherein the developer is a non-magnetic one component developer.

6. An apparatus according to claim 1, wherein said developer carrying member has a length larger than said supply member.

7. An apparatus according to claim 1, wherein said developer carrying member is supplied with an alternating bias voltage.

8. An apparatus according to claim 1, wherein said developer carrying member triboelectrically charges the developer to a polarity for developing the latent image.

9. A developing apparatus, comprising:

a container having a first chamber and a second chamber, said second chamber containing a one component non-magnetic developer;

a rotatable developer carrying member in said first chamber to carry the developer through a developing zone where an electrostatic latent image on an image bearing member is developed;

a developer layer thickness regulating member for forming a first nip with said developer carrying member, said regulating member being effective to regulate a thickness of a layer of the developer carried by said developer carrying member to the developing zone;

a rotatable supply member disposed in said first chamber and cooperative with said developer carrying member to form a second nip, having a length smaller than a length of the first nip, therebetween to supply the developer supplied from said second chamber to said developer carrying member, said second nip is upstream of said first nip with respect to a rotational direction of said developer carrying member; and a partition wall between said first chamber and said second chamber having an opening for permitting supply of the developer from said second chamber to said supply member, wherein the opening has a length smaller than a length of said supply member, and wherein a surface of said developer carrying member is roughened except for longitudinal opposite end portions, and a length of the roughened surface is shorter than the first nip and is longer than the second nip.

10. An apparatus according to claim 9, wherein said supply member is contacted to an edge of the opening.

11. An apparatus according to claim 10, wherein said supply member has an elastic roller.

12. An apparatus according to claim 11, wherein said supply member has a sponge rubber roller.

13. An apparatus according to any one of claims 9–12, wherein said regulating member is an elastic member elastically contacted to the developer carrying member to form the first nip.

14. An apparatus according to claim 6, wherein said opening has a length larger than a length of an image formation area of the image bearing member.

15. An apparatus according to claim 6, further comprising a rotatable developer feeding member in said second chamber, said feeding member feeding the developer in said second chamber to said opening, wherein said feeding member has a length larger than the length of said opening.

16. An apparatus according to claim 9, wherein said developer carrying member is supplied with an alternating bias voltage.

17. An apparatus according to claim 9, wherein said developer carrying member triboelectrically charges the developer to a polarity for developing the latent image.

18. A developing apparatus comprising:

a container having a first chamber and a second chamber, said second chamber containing a one component a non-magnetic developer;

a rotatable developer carrying member in said first chamber to carry the developer through a developing zone where an electrostatic latent image on an image bearing member is developed;

a rotatable supply member disposed in said first chamber and cooperative with said developer carrying member to form a nip therebetween to supply the developer supplied from said second chamber to said developer carrying member;

a partition wall between said first chamber and said second chamber having an opening for permitting supply of the developer from said second chamber to said supply member, wherein the opening has a length smaller than a length of said supply member;

an elastic sheet born on said developer carrying member at a position downstream of said developing zone and upstream of said nip with respect to a rotational direction of said developer carrying member, said elastic sheet being effective to prevent leakage of the developer from said first chamber, wherein the elastic sheet has a length larger than the length of the supply member; and a regulating member born on said developer carrying member at a position downstream of said nip and upstream of the developing zone with respect to the rotational direction of said developer carrying member, said regulating member being effective to regulate a thickness of a layer of the developer carried to the developing zone, wherein said regulating member has a length larger than the length of said supply member.

19. An apparatus according to claim 18, wherein said supply member is contacted to an edge of the opening.

20. An apparatus according to claim 19, wherein said supply member has an elastic roller.

21. An apparatus according to claim 17, wherein said regulating member is an elastic member and is elastically contacted to said developer carrying member.

22. An apparatus according to claim 17, wherein a surface of said developer carrying member is roughened except for the opposite longitudinal end portions, and a length of the roughened surface is shorter than said regulating member and said elastic sheet.

23. An apparatus according to claim 17, wherein said opening has a length larger than an image formation area of the image bearing member.

24. An apparatus according to claim 17, further comprising a rotatable developer feeding member in said second chamber, said feeding member feeding the developer in said second chamber to said opening, wherein said feeding member has a length larger than the length of said opening.

25. An apparatus according to claim 18, wherein said developer carrying member has a length larger than said supply member.

26. An apparatus according to claim 25, wherein aid developer carrying member has a length larger than that of said regulating member.

27. An apparatus according to claim 18, wherein said developer carrying member is supplied with an alternating bias voltage.

28. An apparatus according to claim 18, wherein said developer carrying member triboelectrically charges the developer, to a polarity for developing the latent image.

29. A developing apparatus, comprising:

a container having a first chamber and a second chamber, said second chamber containing a one component non-magnetic developer;

a rotatable developer carrying member in said first chamber to carry the developer through a developing zone where an electrostatic latent image on an image bearing member is developed;

a developer layer thickness regulating member for forming a first nip with said developer carrying member, said regulating member being effective to regulate a thickness of a layer of the developer carried by said developer carrying member to the developing zone;

a rotatable supply member disposed in said first chamber and cooperative with said developer carrying member to form a second nip, having a length smaller than a length of the first nip, therebetween to supply the developer supplied from said second chamber to said developer carrying member, said second nip is upstream of said first nip with respect to a rotational direction of said developer carrying member; and a partition wall between said first chamber and said second chamber having an opening for permitting supply of the developer from said second chamber to said supply member, wherein the opening has a length smaller than a length of said supply member and a length larger than an image formation area of the image bearing member.

30. An apparatus according to claim 25, further comprising a rotatable developer feeding member in said second chamber, said feeding member feeding the developer in said second chamber to said opening, wherein said feeding member has a length larger than the length of said opening.

31. An apparatus according to claim 29, wherein said supply member contacts an edge of the opening.

32. An apparatus according to claim 31, wherein said supply member has an elastic roller contacting the developer carrying member to form the second nip.

33. An apparatus according to claim 32, wherein said supply member has a sponge rubber roller.

34. An apparatus according to any one of claims 25, 27–29, wherein said regulating member is an elastic member elastically contacting the developer carrying member to form the first nip.

35. An apparatus according to claim 29, wherein said developer carrying member is supplied with an alternating bias voltage.

36. An apparatus according to claim 29, wherein said developer carrying member triboelectrically charges the developer to a polarity for developing the latent image.

37. A developing apparatus, comprising:

a container having a first chamber and a second chamber, said second chamber containing a one component non-magnetic developer;

a rotatable developer carrying member in said first chamber to carry the developer through a developing zone where an electrostatic latent image on an image bearing member is developed;

a developer layer thickness regulating member for forming a first nip with said developer carrying member, said regulating member being effective to regulate a thickness of a layer of the developer carried by said developer carrying member to the developing zone;

a rotatable supply member disposed in said first chamber and cooperative with said developer carrying member to form a second nip, having a length smaller than a length of the first nip, therebetween to supply the developer supplied from said second chamber to said developer carrying member, said second nip is upstream of said first nip with respect to a rotational direction of said developer carrying member; and a partition wall between said first chamber and said second chamber having an opening for permitting supply of the developer from said second chamber to said supply member, wherein the opening has a length smaller than a length of said supply member.

38. An apparatus according to claim 37, wherein said supply member contacts an edge of the opening.

39. An apparatus according to claim 38, wherein said supply member has an elastic roller contacting the developer carrying member to form the second nip.

40. An apparatus according to claim 39, wherein said supply member has a sponge rubber roller.

41. An apparatus according to any one of claims 37, 38-40, wherein said regulating member is an elastic member elastically contacting the developer carrying member to form the first nip.

42. An apparatus according to claim 37, wherein said developer carrying member is supplied with an alternating bias voltage.

43. An apparatus according to claim 37, wherein said developer carrying member triboelectrically charges the developer to a polarity for developing the latent image.

44. A developing apparatus, comprising:

a container for containing a one component non-magnetic developer;

a rotatable developer carrying member in said container to carry the developer through a developing zone where an electrostatic latent image is developed on an image bearing member;

a developer layer thickness regulating member for forming a first nip with said developer carrying member, said regulating member being effective to regulate a thickness of a layer of the developer carried by said developer carrying member to the developing zone; and a rotatable supply member disposed in said container and cooperative with said developer carrying member to form a second nip therebetween to supply the developer to said developer carrying member, said second nip is upstream of said first nip with respect to a rotational direction of said developer carrying member, wherein the second nip has a length smaller than a length of the first nip.

45. An apparatus according to claim 44, wherein said length of said second nip is larger than a length of an image formation area of the image bearing member.

46. An apparatus according to claim 44 or 45, wherein said supply member has an elastic roller contacted to the developer carrying member to form the second nip.

47. An apparatus according to claim 46, wherein said supply member has a sponge rubber roller.

48. An apparatus according to claim 46, wherein said regulating member is an elastic member elastically contacted to the developer carrying member to form the first nip.

49. An apparatus according to claim 48, wherein said developer carrying member triboelectrically charges the developer to a polarity for developing the latent image.

50. An apparatus according to claim 49, wherein said developer carrying member is supplied with an alternating bias voltage.

51. A developing apparatus, comprising:

a container for containing a one component non-magnetic developer;

a rotatable developer carrying member in said container to carry the developer through a developing zone where an electrostatic latent image is developed on an image bearing member;

a developer layer thickness regulating member for forming a first nip with said developer carrying member, said regulating member being effective to regulate a thickness of a layer of the developer carried by said developer carrying member to the developing zone; and a rotatable supply member disposed in said container and cooperative with said developer carrying member to form a second nip therebetween to supply the developer to said developer carrying member, said second nip is upstream of said first nip with respect to a rotational direction of said developer carrying member, wherein said second nip has a length larger than a length of an image formation area of the image bearing member.

52. An apparatus according to claim 51, wherein said supply member has an elastic roller contacted to the developer carrying member to form the second nip.

53. An apparatus according to claim 52, wherein said supply member has a sponge rubber roller.

54. An apparatus according to claim 51-53, wherein said regulating member is an elastic member elastically contacted to the developer carrying member to form the first nip.

55. An apparatus according to claim 54, wherein said developer carrying member triboelectrically charges the developer to a polarity for developing the latent image.

56. An apparatus according to claim 55, wherein said developer carrying member is supplied with an alternating bias voltage.

57. A developing apparatus, comprising:

a container for containing a one component non-magnitude developer;

a rotatable developer carrying member in said container to carry the developer through a developing zone where an electrostatic latent image on an image bearing member is developed, wherein a surface of the developer carrying member is roughened;

a developer layer thickness regulating member for forming a first nip with said developer carrying member, said regulating member being effective to regulate a thickness of a layer of the developer carried by said developer carrying member to the developing zone; and a rotatable supply member disposed in said container and cooperative with said developer carrying member to form a second nip therebetween to supply the developer to said developer carrying member, said second nip is upstream of said first nip with respect to a rotational direction of said developer carrying member, wherein a length of said second nip is shorter than a length of said roughened surface of the developer carrying member.

58. An apparatus according to claim 51, wherein said length of said second nip is longer than a length of an image formation area of the image bearing member.

59. An apparatus according to claim 57, wherein a length of said first nip is longer than said length of said roughened surface of the developer carrying member.

60. An apparatus according to claim 59, wherein said length of said second nip is longer than a length of an image formation area of the image bearing member.

61. An apparatus according to any one of claims 57–60, wherein said supply member has an elastic roller contacting the developer carrying member to form the second nip.

62. An apparatus according to claim 61, wherein said supply member has a sponge rubber roller.

63. An appartaus according to claim 61, wherein said regulating member is an elastic member elastically contacting the developer carrying member to form the first nip.

64. An apparatus according to claim 63, wherein said developer carrying member triboelectrically charges the developer to a polarity for developing the latent image.

65. An apparatus according to claim 64, wherein said developer carrying member is supplied with an alternating bias voltage.

66. An apparatus according to claim 63, wherein the surface of said developer carrying member is roughened by sand-blasting.

67. A developing apparatus comprising:

a container for containing a one component non-magnetic developer;

a rotatable developer carrying member in said container to carry the developer through a developing zone where an electrostatic latent image is developed on an image bearing member;

a rotatable supply member disposed in said container and cooperative with said developer carrying member to form a nip therebetween to supply the developer to said developer carrying member;

a leakage preventing member born on said developer carrying member at a position downstream of said developing zone and upstream of said nip with respect to a rotational direction for said developer carrying member, said leakage preventing member being effective to prevent leakage of the developer from said container, wherein the leakage preventing member has a length larger than a length of the nip.

68. An apparatus according to claim 67, wherein said supply member has an elastic roller contacted to the developer carrying member to form the nip.

69. An apparatus according to claim 67 or 68, wherein said developer carrying member triboelectrically charges the developer to a polarity for developing the latent image.

70. An apparatus according to claim 69, wherein said developer carrying member is supplied with an alternating bias voltage.

71. An apparatus according to claim 67, wherein said leakage preventing member is in the form of an elastic sheet.

* * * * *

UNITED STATES PATENT AND TRADEMARK OFFICE

CERTIFICATE OF CORRECTION

PATENT NO. : 5,075,728

DATED : December 24, 1991

INVENTOR(S) : YOSHIAKI KOBAYASHI, ET AL.

It is certified that error appears in the above-identified patent and that said Letters Patent is hereby corrected as shown below:

ON THE TITLE PAGE

IN [30] FOREIGN APPLICATION PRIORITY DATA

"Sep. 29, 1989" should read --Aug. 29, 1989--.

COLUMN 4

Line 16, "the," should read --the--.
Line 57, "non-contacts" should read --non-contacted--.

COLUMN 5

Line 32, "metal cap." should read --metal core.--.

COLUMN 8

Line 8, "are" should read --area--.

COLUMN 9

Line 5, "claim 6," should read --claim 9,--.
Line 8, "claim 6," should read --claim 9,--.
Line 24, "a" should be deleted.
Line 61, "claim 17," should read --claim 18,--.
Line 64, "claim 17," should read --claim 18,--.

COLUMN 10

Line 1, "claim 17," should read --claim 18,--.
Line 4, "claim 17," should read --claim 18,--.
Line 13, "aid" should read --said--.
Line 21, "developer," should read --developer--.

UNITED STATES PATENT AND TRADEMARK OFFICE

CERTIFICATE OF CORRECTION

PATENT NO. : 5,075,728

DATED : December 24, 1991

INVENTOR(S) : YOSHIAKI KOBAYASHI, ET AL.

It is certified that error appears in the above-identified patent and that said Letters Patent is hereby corrected as shown below:

COLUMN 10

Line 54, "claim 25," should read --claim 29,--.
Lines 67-68, "claims 25, 27-29," should read --claims 29, 31-33,--.

COLUMN 13

Line 2, "nitude" should read --netic--.
Line 25, "claim 51," should read --claim 57,--.

Signed and Sealed this

Eighth Day of June, 1993

*Attest:*

Michael K. Kirk

MICHAEL K. KIRK

*Attesting Officer*

*Acting Commissioner of Patents and Trademarks*